US012016481B2

(12) United States Patent
Wakeham

(10) Patent No.: US 12,016,481 B2
(45) Date of Patent: Jun. 25, 2024

(54) PILLOW CASE COVER

(71) Applicant: Leslie Wakeham, Parker, CO (US)

(72) Inventor: Leslie Wakeham, Parker, CO (US)

( * ) Notice: Subject to any disclaimer, the term of this patent is extended or adjusted under 35 U.S.C. 154(b) by 0 days.

(21) Appl. No.: 17/227,870

(22) Filed: Apr. 12, 2021

(65) Prior Publication Data

US 2021/0321799 A1 Oct. 21, 2021

Related U.S. Application Data

(60) Provisional application No. 63/012,357, filed on Apr. 20, 2020.

(51) Int. Cl.
*A47G 9/02* (2006.01)
*A47G 9/04* (2006.01)

(52) U.S. Cl.
CPC ..... *A47G 9/0253* (2013.01); *A47G 9/04* (2013.01)

(58) Field of Classification Search
CPC ..... A47G 9/0253; A47G 9/0261; A47G 9/04; A47G 9/10; A47G 9/1009
See application file for complete search history.

(56) References Cited

U.S. PATENT DOCUMENTS 2,853,068 A * 9/1958 Povel ..... A47G 9/04 128/872
5,070,558 A * 12/1991 Fenley ..... A47G 9/10 5/636
5,758,375 A * 6/1998 Horowitz ..... A47G 9/10 5/951
5,765,245 A * 6/1998 Breto ..... A47G 9/10 5/636
5,839,138 A * 11/1998 Weidman ..... A47G 9/10 5/636
10,918,229 B1 * 2/2021 Mello ..... A47G 9/04
2004/0255499 A1 * 12/2004 Kirschhoffer ..... G09F 3/20 40/658
2005/0150048 A1 * 7/2005 Hamilton ..... A47G 9/0253 5/490
2007/0245493 A1 * 10/2007 Leifermann ..... A47G 9/0253 5/636

(Continued)

OTHER PUBLICATIONS

Screenshots from various websites showing a product called a PILLOWCAP.

*Primary Examiner* — David R Hare
*Assistant Examiner* — George Sun
(74) *Attorney, Agent, or Firm* — Leyendecker & Lemise LLC

(57) ABSTRACT

A fitted pillow cover having a body of a single piece of satin or cotton fabric that has a tubular channel formed around its perimeter, and an elastic cord assembly comprising an elastic cord and ribbons that is received in the tubular channel with each of the ribbons emanating from an opening in the tubular channel. The elastic cord, which in its relaxed state is typically shorter than the length of the perimeter of the tubular channel, causes the tubular channel and fabric proximate the channel to bunch and fold over on itself. The ribbons are wider than the diameter of the tubular channel and the channel opening, preventing the ends of the elastic cord assembly from being pulled into the channel. The single piece of fabric with its perimeter folded over by the elastic cord assembly forms into a pocket that can be received over pillows of various sizes.

18 Claims, 4 Drawing Sheets

(56) References Cited

U.S. PATENT DOCUMENTS

| | | | | |
|---|---|---|---|---|
| 2010/0220953 | A1* | 9/2010 | Kewitsch | G02B 6/3502 385/17 |
| 2012/0066837 | A1* | 3/2012 | Thorsen | A47G 9/10 5/652 |
| 2013/0125435 | A1* | 5/2013 | Keever | G09F 7/02 40/620 |
| 2013/0192539 | A1* | 8/2013 | Woodruff | A01K 27/005 119/798 |
| 2013/0227784 | A1* | 9/2013 | Holliday | A47G 9/0253 5/490 |
| 2015/0089742 | A1* | 4/2015 | Aas-Jakobsen | A47D 13/083 5/632 |
| 2016/0174738 | A1* | 6/2016 | Nekhala | A47G 9/04 24/72.5 |
| 2016/0302595 | A1* | 10/2016 | Francois | A47G 9/0253 |
| 2017/0020310 | A1* | 1/2017 | Garg | D03D 13/008 |
| 2017/0035210 | A1* | 2/2017 | Nekhala | A47G 9/0246 |
| 2019/0008294 | A1* | 1/2019 | Marshall | A47G 9/10 |
| 2019/0045952 | A1* | 2/2019 | Porter | A47G 9/04 |
| 2020/0260886 | A1* | 8/2020 | Chen | A47C 21/022 |

* cited by examiner

PILLOW CASE COVER

RELATED APPLICATIONS

This application claims priority to and fully incorporates by reference herein U.S. Provisional Patent Application 63/012,357 filed on Apr. 20, 2020 entitled "Pillow Case Cover" and having the same inventor as the present application.

BACKGROUND

Traditional pillow cases can be somewhat annoying and time consuming to place over a pillow: for instance, if the case is longer than the pillow, it may need to be tucked into the opening. Sometimes the pillow may become folded within the pillow case after use and require straightening.

When traveling people may need to use pillows offered by others if they have not brought their own pillow. As can be appreciated bringing one's own pillow on vacation may not be an option as it can take up valuable luggage space. However, pillows offered by hotels or airlines have been potentially used by dozens if not hundreds of other people between washes. While the pillow case on these pillows, may have been more recently washed, the effectiveness of the wash process may not be up to the desires or standards of the user. Further, the pillow cases may be made of a material or materials that are irritating to the user's face and/or washed in laundry detergent that leaves residues that may also be irritating to the user's face. Some fabrics may even damage the user's hair.

Some travelers pack their own pillow cases for use on pillows other than their own but these can be bulky and sometimes difficult to quickly put over a pillow as mentioned above. Additionally, the user may forget to remove his/her pillow case from a pillow after use only to have the cleaning staff remove the cover to be laundered with hotel bedding not knowing the cover is owned by a guest.

DETAILED DESCRIPTION

Figure 1:
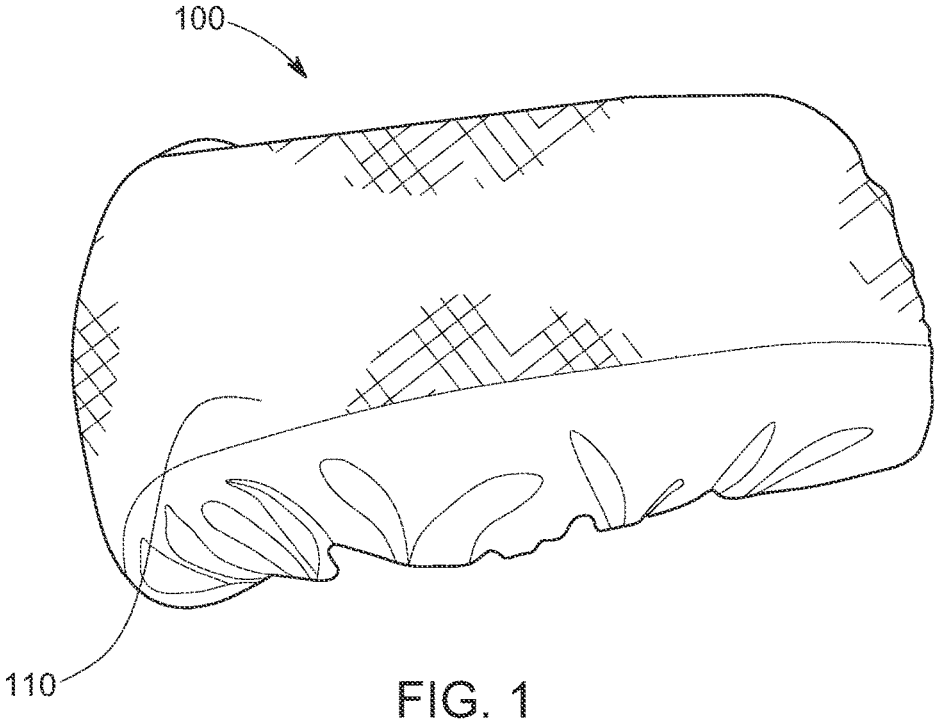
FIG. 1 is a perspective front view of the pillow cover installed on a pillow according to an embodiment of the present invention.

The fitted pillow cover of the present embodiment typically comprises a body of single piece of satin or cotton fabric that has a tubular channel formed around its perimeter. An elastic cord assembly comprising an elastic cord and ribbons is received in the tubular channel with each of the ribbons emanating from an opening in the tubular channel. The elastic cord, which in its relaxed state is typically shorter than the length of the perimeter of the tubular channel, causes the tubular channel and fabric proximate the channel to bunch and fold over on itself. The ribbons, which are wider than the diameter of the tubular channel and the channel opening, prevent the ends of the elastic cord assembly from being pulled into the channel. The single piece of fabric with its perimeter folded over by the elastic cord assembly forms into a pocket that can be received over pillows of various sizes. The cover typically exhibits a smooth seamless front face when installed over the pillow upon which a user can lay her head while sleeping or resting.

Embodiments of the cover are easy to install and remove especially when compared to traditional style pillow cases. One size of cover can be used on different size pillows from standard to king without the need to fold over the end of the pillow cover as with a prior art pillow case. The cover can easily be installed over pillows that already have pillow cases attached thereto making its use on hotel pillows easy without the need to remove the hotel's pillow case from its pillow. The tightness of the cinching of the elastic cord assembly around a pillow can also be adjusted as necessary by untying the ribbons of the elastic cord assembly and adjusting the length of elastic cord received in the tubular channel.

The ease of installation and removal of the embodiments of the pillow cover encourages frequent removal and washing to ensure a maximum level of cleanliness. This is in sharp contrast to prior art traditional pillow cases, which are often a challenge and inconvenient to change, and are often left in place far too long causing a user to rest her head on a surface that includes dirt, oil, dead skin cells, bacteria, and sweat deposits from numerous previous uses. Use of dirty traditional prior art pillow cases can result in increased skin breakouts, acne, infections, illness and allergies. Further, dirty pillow cases can be a haven for dust mites, bed bugs, and even fungus.

Embodiments of the cover are typically provided with a storage pouch or bag that permits a user to easily pack or stow it in a suitcase, other luggage or even a purse so that it can be used whenever a need arises ensuring she is sleeping with her head on a clean surface. Additionally, embodiments comprised of finely woven satin or fine cotton fabric that can help protect the user's hair and skin from damage when compared to coarser and more abrasive fabrics.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

An Embodiment of a Pillow Cover

An embodiment of the fitted pillow cover 100 and its components are illustrated in FIGS. 1-5. Typically, the cover comprises (i) a single piece of circular or ovular fabric forming the fabric body 110 that includes a tubular channel 140 that extends along the fabric body's perimeter, and (ii) an elastic cord assembly 115 comprising a relatively thin elastic cord 130 with wider ribbons 120. The elastic cord assembly is substantially received in the tubular channel to cause the channel and surrounding fabric to bunch and the pillow cover to form a pocket into which a pillow 200 can be received.

Figure 6:
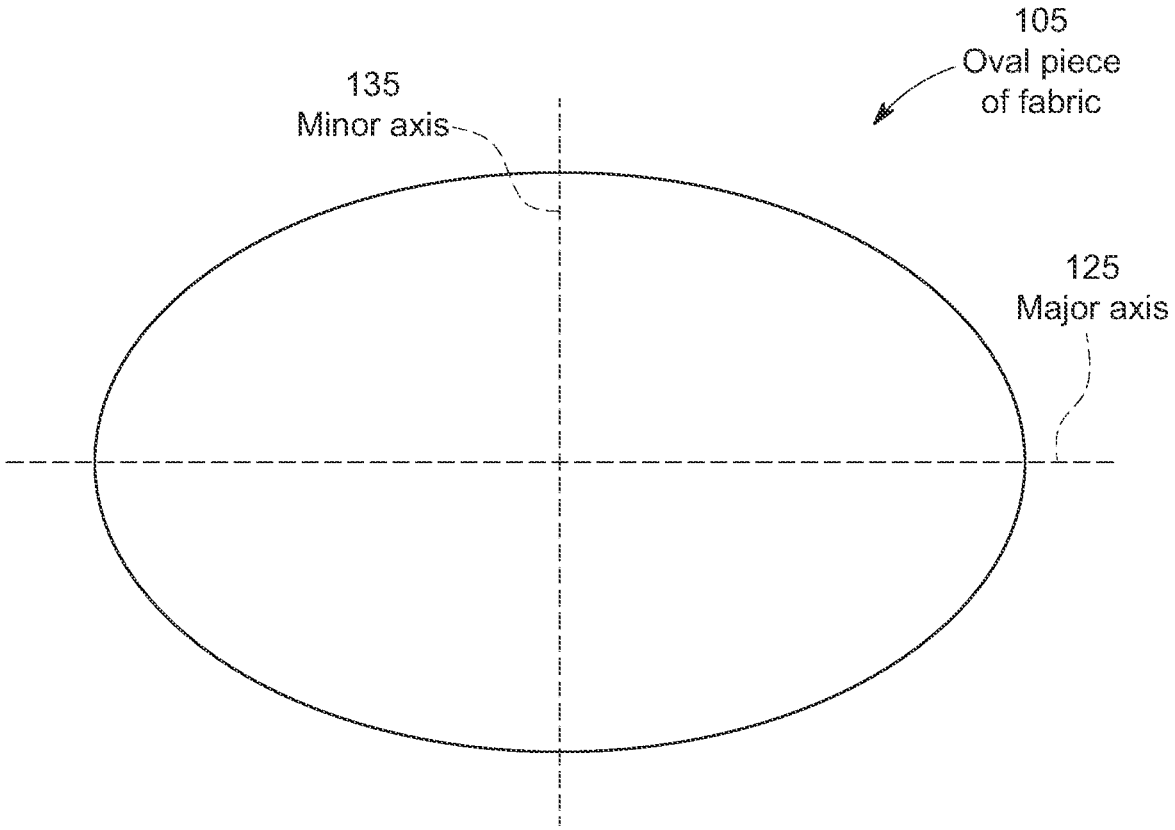
FIG. 6 is a top view of a single piece of seamless ovular fabric used to fabricate the pillow cover prior to forming the perimeter tubular channel thereon according to an embodiment of the present invention.

The fabric body 110 and associated tubular channel can best be seen in FIGS. 1, 2, 3*a* & 3*b*. The fabric body can be comprised of any suitable fabric material and comprised of as many pieces sewn together or otherwise combined as is desirable; however, the illustrated embodiment is typically comprised of an ovular fabric piece 105 having a longer major axis 125 and a shorter minor axis 135. The single piece of fabric is best shown in FIG. 6 and comprises no seams, sewn or otherwise extending into or across the fabric piece's face. In the illustrated embodiments, the only sewn portions of the cover are to form and create the tubular channel at the fabric body's perimeter. The fabric piece typically has a very fine weave to maximize comfort and reduce the cover's abrasiveness to the lowest possible levels.

In one variation, the fabric body 110 primarily comprises a 100% pure cotton fabric piece 105 preferably having a thread count of at least 150 tpi (threads per inch), more preferably at least 200 tpi, and most preferably at least 250 tpi. The cotton fabric piece can have any suitable weave structure but plain weave or satin weave are most typical.

In another variation, a satin fabric piece 105 comprising fine polyester is utilized for the fabric body 110. The fabric piece can also have similar thread counts as the cotton fabric used in the cotton fabric body variation. In yet other variations, silk fibers or other types of fibers can be substituted for the polyester fibers.

The tubular channel 140 extends around substantially all of the perimeter of the fabric body 110 and is typically formed by folding the perimeter edge of the fabric back onto itself and sewing or otherwise joining the fabric at locations a small distance inward of the edge to form the tube or tubular channel. A channel opening 145 is provided through the tubular channel at a desired location through which the elastic cord assembly can be threaded. The channel opening is large enough so that both ends of the elastic cord can exit the opening with the elastic cord section there between residing in the tubular channel.

The location of the channel opening 145 can be anywhere along the tubular channel 140 although in some variations the opening is provided at an end of the major axis of the ovular piece of fabric. By locating the channel opening at this particular spot, the user is quickly ably to index how the fitted cover 100 is to be received over a rectangular pillow 200. Simply, as discussed below, the opening is positioned at the proximate center of a short side of the pillow to ensure the shorter portions of the ovular body correspond to the short sides of the pillow and the longer portions of the ovular body correspond to the long sides of the pillow.

Figure 3A:
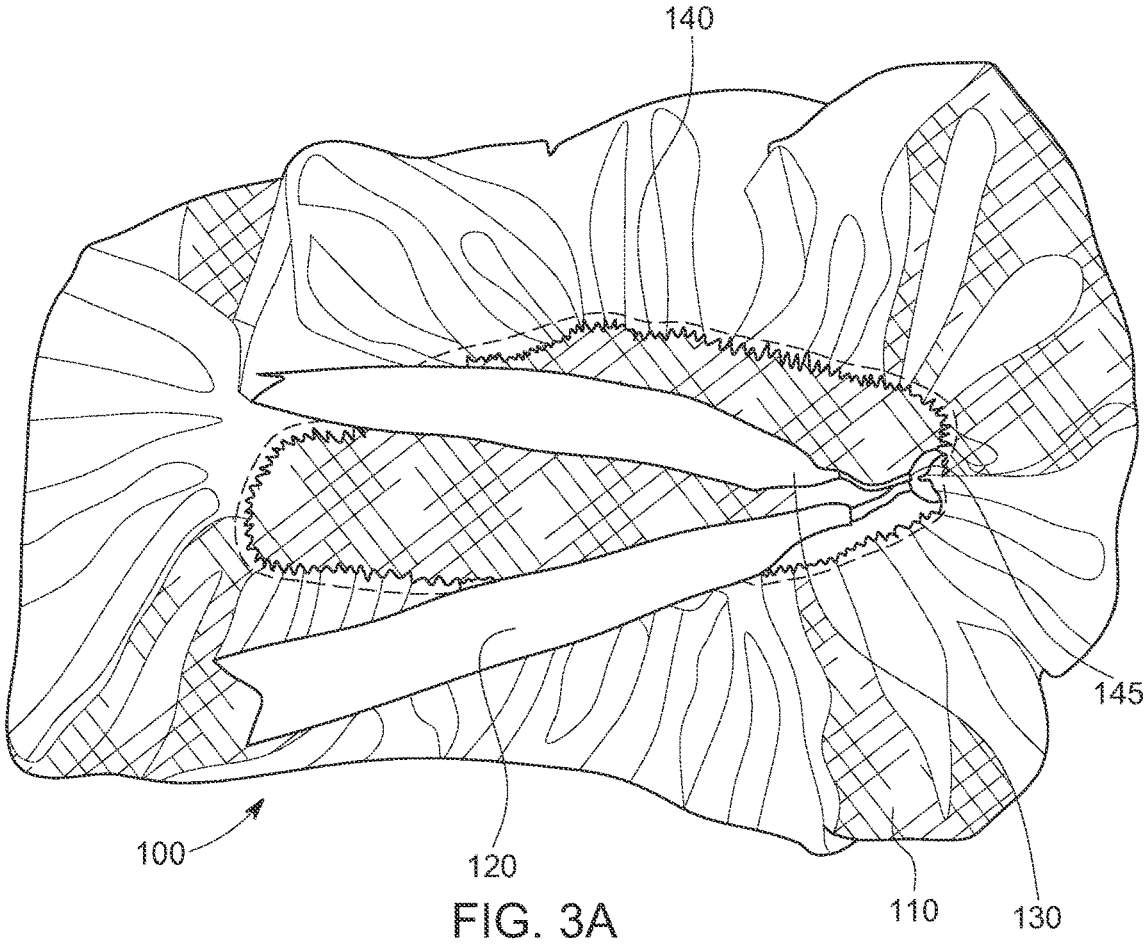
FIG. 3*a* is a perspective back view of the pillow cover alone with the elastic draw string untied according to an embodiment of the present invention.
Figure 3B:
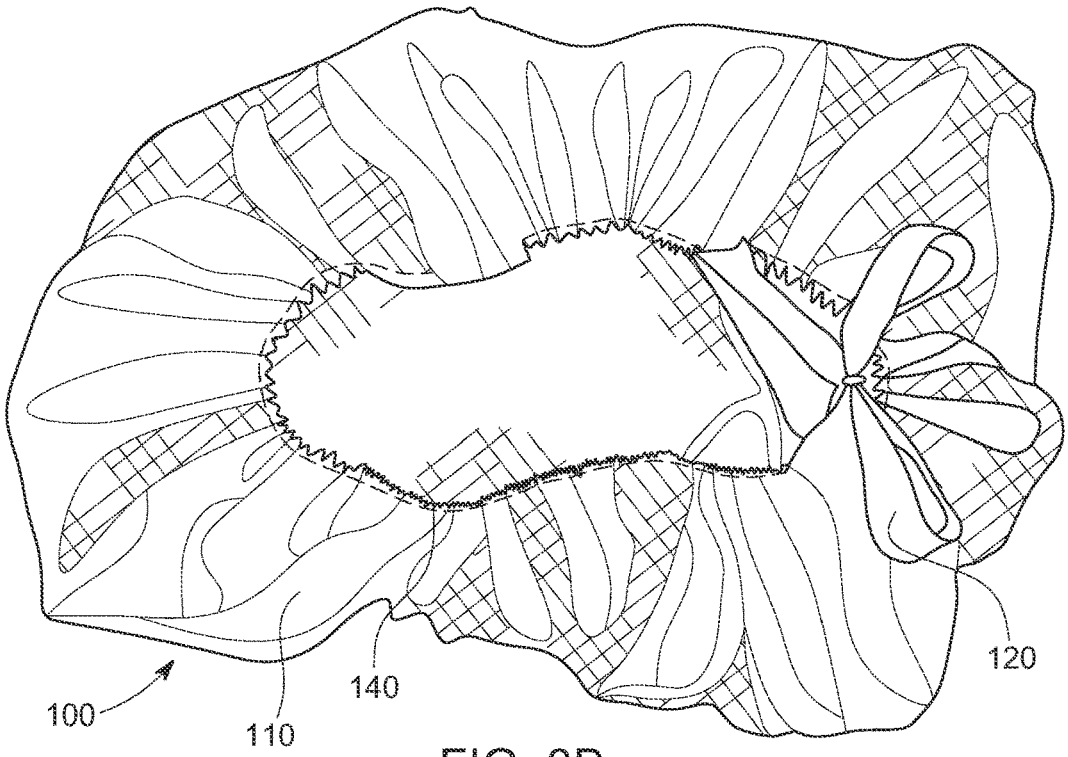
FIG. 3*b* is a perspective back view of the pillow cover alone with the elastic draw string tied into a bow according to an embodiment of the present invention.
Figure 4:
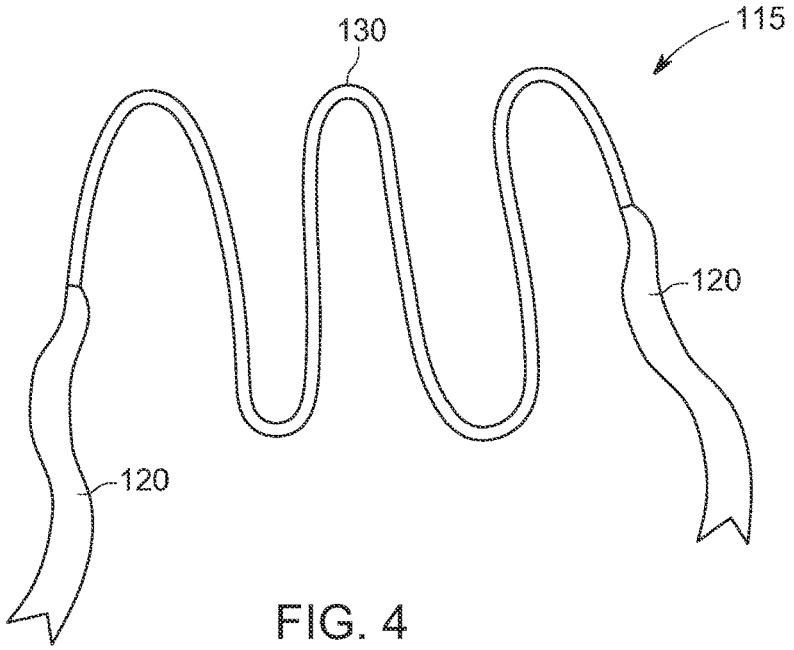
FIG. 4 is a perspective view of the elastic draw string assembly including the ribbons according to an embodiment of the present invention.

In one embodiment the elastic strap 130 of the elastic strap assembly 115 comprises ¼" braided elastic cord with the capability of elastically stretching about 100-200% or more. Nylon ribbons 120 about 1"-2" in width and 10-12" in length are sewn or otherwise attached to each end of the elastic cord to form the ribbons 120. The ribbons are too wide to be pulled substantially into the tubular channel through the provided opening. The ribbons give a user something to hold when adjusting the length of the elastic cord in the channel, and accordingly, the fit of the pillow case around a pillow as may need to be adjusted depending on the size of the pillow. With reference to FIGS. 3*a* & 3*b*, the ribbons can be tied into a bow to present the pillow cover will a more finished and decorative appearance, or alternatively, the ribbon can remain untied and optionally stuffed underneath the fabric body.

The length of the elastic cord varies with the size of the fabric body 110, and more particularly, the perimeter length of the tubular channel. Typically, the elastic cord is about 25-75% the length of the tubular channel. As such, when received in the tubular channel, the elastic retracts to its relaxed length and causes the perimeter of the fabric body to bunch up as shown best in FIGS. 2, 3*a* & 3*b* and causes the fabric body to form a pocket into which the pillow can be received.

As can be appreciated, some variations can use a non-elastic cord or draw string in place of the elastic cord. Further the diameter or width of the cord can vary as can the length and width of the ribbons 120.

Figure 5:
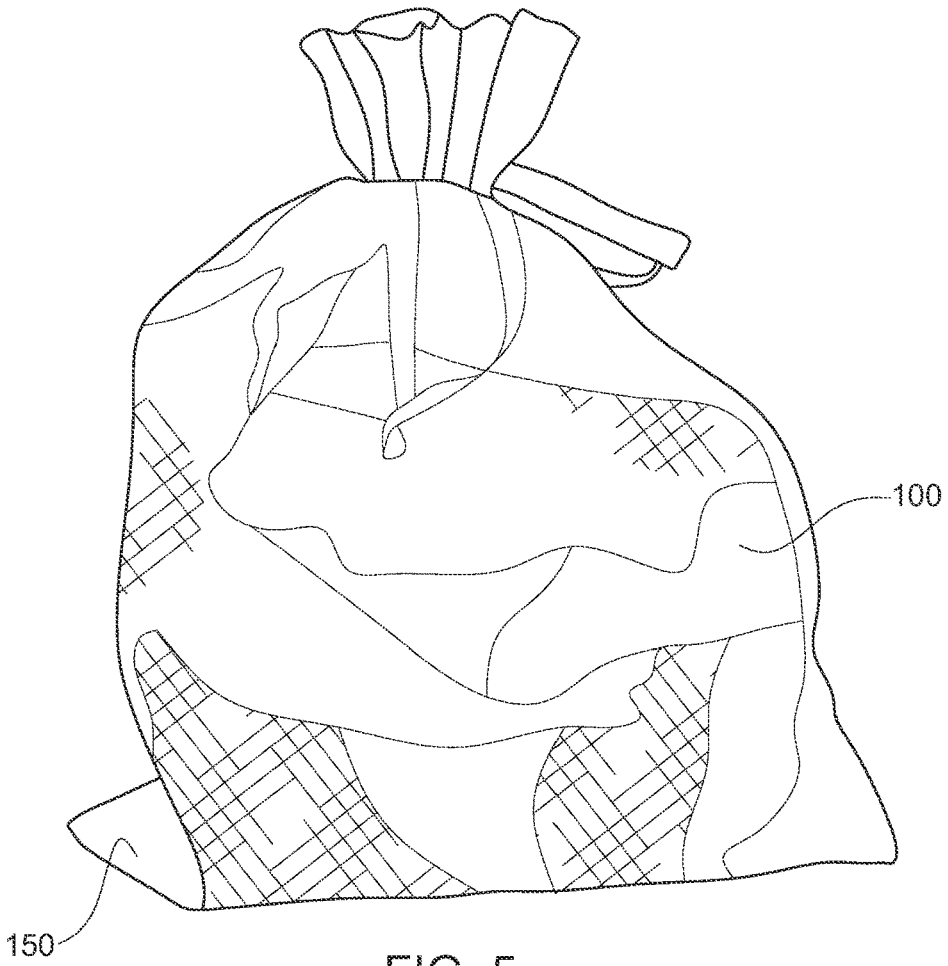
FIG. 5 is a perspective view of the pillow cover contained in its travel/storage bag according to an embodiment of the present invention.

As shown in FIG. 5, the pillow fitted cover 100 is typically provided with a storage satchel or bag 150 to help keep it clean and provide a convenient means of storing the cover during transport. The cover can be neatly folded and placed in the storage bag or stuffed therein depending largely on user preference. The storage bag with the cover therein is relatively small, and accordingly, it does not take up significant space in a suitcase in contrast to a pillow itself.

Methods of Using the Embodiment of the Pillow Cover

Embodiments of the fitted cover 100 can be used over any suitable sized pillow 200. Most typically, embodiments of the cover are sized for use on both standard and king sized bed pillows; however, because of the sizing versatility offered by the cover's design, any particular cover can be used on pillows on a wide variety of pillow sizes. Furthermore, the cover can as easily be installed on a pillow that already has a traditional pillow case on it just as easily as it can be installed on a naked pillow. Furthermore, the ease and quickness of which the cover can be installed facilitates and encourages its use where a user would be inclined to pass with a traditional pillow case because of its relative difficulty of use.

To install the fitted cover 100, a user simply slips the end (typically the narrow or short end) of a pillow 200 into a portion of the pocket formed by the cinched body and pulls the remainder of the cover over and around the rest of the pillow's front. In some embodiments the cover's configuration is such that the location of the ribbons 120 and the opening 145 into the tubular channel correspond to the middle of one of the shorter sides of a bed pillow and this can be used as a gauge as to where to first slip the cover over the pillow best aligning the pillow and the ovular fabric body of the cover. Depending on the size of the pillow, the ribbons of the elastic cord assembly can be tied or untied.

Figure 2:
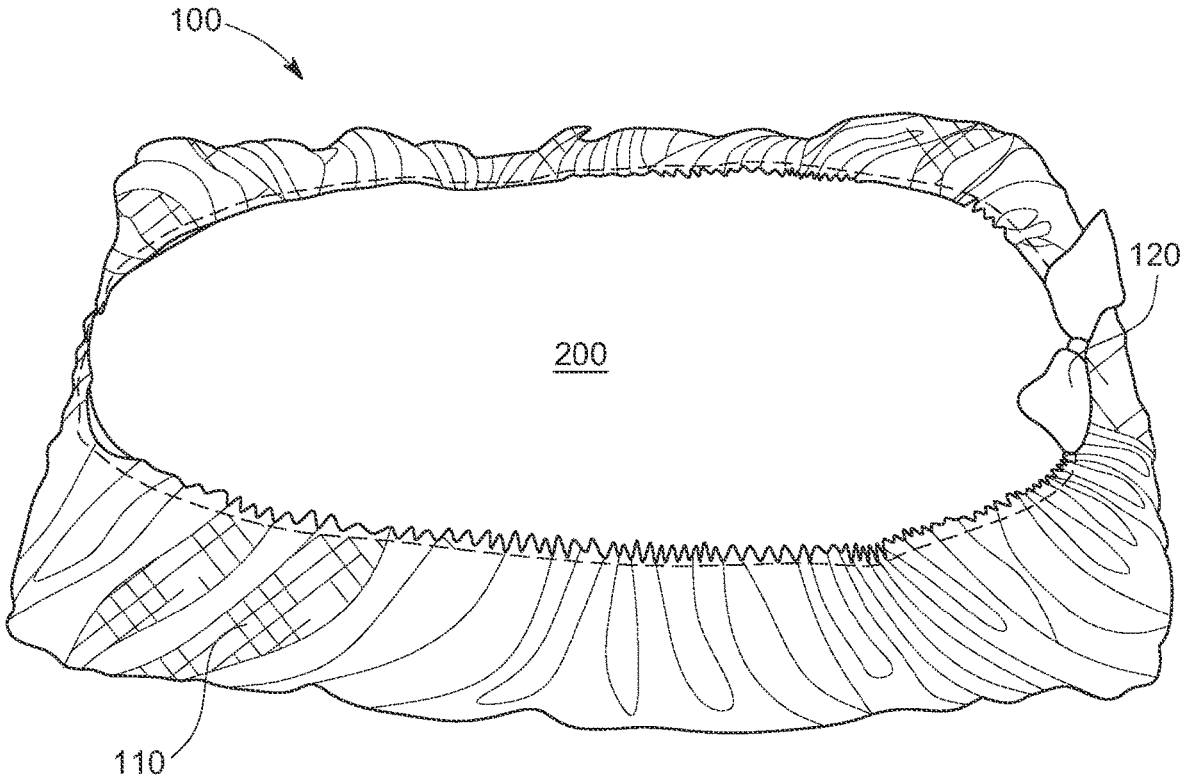
FIG. 2 is a perspective back view of the pillow cover installed on a pillow according to an embodiment of the present invention.

Once installed over the front of the pillow 100 with the tubular channel 140 and associated elastic cord assembly 115 being received on the back side of the pillow, a user will typically adjust the cover's positioning as necessary and smooth out the front to eliminate wrinkles as best shown in FIG. 1. As desired and necessary, this may include tightening the elastic cord assembly in the tubular channel and tying the ribbons 120 into a bow as can be seen in FIG. 2.

Next, the user can lie on and/or sleep on the pillow 200. When done using the fitted cover 100, it can be easily removed by pulling the pillow out from the bottom opening of the cover. The cover can be stored, optionally in its storage bag 150, awaiting future use. Alternatively, the cover can be laundered.

Other Variations and Embodiments

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A pillow cover, the pillow cover comprising:

an ovular fabric body of substantially a single piece of fabric, the fabric body having a tubular channel of a channel diameter extending around substantially all of a fabric body perimeter, the tubular channel having at least one channel opening; and an elastic cord assembly, the elastic cord assembly including (i) an elongated elastic cord with first and second cord ends having an elastic elongation sufficient to at least double an unstretched length of the elastic cord and a cord width, the cord width being less than the channel diameter, (ii) a first ribbon distinct from the elastic cord having a first ribbon width and distal and proximal first ribbon ends with the first ribbon width being substantially greater than the channel diameter, and (iii) a second ribbon distinct from the elastic cord having a second ribbon width and distal and proximal second ribbon ends with the second ribbon width being substantially greater than the channel diameter;

wherein (a) the unstretched length of the elastic cord is 75% or less than an unbunched perimeter length of the tubular channel, (b) the elastic cord is substantially contained within the tubular channel wherein the tubular channel is bunched having an effective bunched perimeter length substantially the same as the unstretched length, (c) the proximal first ribbon end is joined to a first cord end, (d) the proximal second ribbon end is joined to a second cord end, and (e) substantially all of the first and second ribbons are outside of the tubular channel butted up against the at least one channel opening with the elastic cord assembly passing through the at least one channel opening.

2. The pillow cover of claim 1 wherein the single piece of fabric comprises 100% cotton.

3. The pillow cover of claim 2 wherein the single piece of fabric has a plain weave.

4. The pillow cover of claim 2 wherein the single piece of fabric has a satin weave.

5. The pillow cover of claim 2 wherein the single piece of fabric has a thread count of at least 150 threads per inch.

6. The pillow cover of claim 1 wherein the single piece of fabric comprises 100% polyester.

7. The pillow cover of claim 6 wherein the single piece of fabric has a satin weave.

8. The pillow cover of claim 6 wherein the single piece of fabric has a thread count of at least 150 threads per inch.

9. The pillow cover of claim 1, wherein the elastic cord has an elongation of at least 150% sufficient to increase the elastic cord to a stretched length at least two and a half times the unstretched length.

10. The pillow cover of claim 1, wherein the channel opening is located on an end of a major axis of the oval.

11. The pillow cover of claim 1, wherein the unstretched length of the elastic cord in an unstretched state is 50% or less the length of the unbunched perimeter length of the tubular channel fabric body perimeter.

12. The pillow cover of claim 1 wherein the elastic cord comprises braided elastic cord.

13. The pillow cover of claim 1 in combination with a pillow, the cover being received and secured over the pillow, the pillow having a front side and a back side.

14. The combination of claim 13, wherein the fabric body is substantially smooth over the front side.

15. The combination of claim 14, wherein the tubular channel is substantially located on the back side.

16. The pillow cover of claim 1 in combination with a storage bag, the cover being received in the storage bag.

17. A pillow cover, the pillow cover comprising:

an ovular fabric body consisting substantially of a single piece of fabric having a thread count of at least 150 threads per inch, the fabric body having a tubular channel of a channel diameter extending around substantially all of a fabric body perimeter, the tubular channel having at least one channel opening, the channel opening is located on an end of the major axis of the fabric body; and an elastic cord assembly, the elastic cord assembly including (i) an elongated elastic cord with first and second cord ends having an elastic elongation sufficient to at least double an unstretched length of the elastic cord 100% and a cord width, the cord width being less than the channel diameter, (ii) a first ribbon distinct from the elastic cord having a first ribbon width and distal and proximal first ribbon ends with the first ribbon width being substantially greater than the channel diameter, and (iii) a second ribbon distinct from the elastic cord having a second ribbon width and distal and proximal second ribbon ends with the second ribbon width being substantially greater than the channel diameter;

wherein (a) the unstretched length of the elastic cord is 75% or less than an unbunched perimeter length of the tubular channel, (b) the elastic cord is substantially contained within the tubular channel wherein the tubular channel is bunched having an effective bunched perimeter length substantially the same as the unstretched length, (c) the proximal first ribbon end is joined to a first cord end, (d) the proximal second ribbon end is joined to a second cord end, and (e) substantially all of the first and second ribbons are outside of the tubular channel butted up against the at least one channel opening with the elastic cord assembly passing through the at least one channel opening.

18. A combination comprising a pillow with a front side and a back side and a pillow cover received and secured over the pillow, the pillow cover comprising:

an ovular fabric body, the fabric body having a tubular channel of a channel diameter extending around substantially all of a fabric body perimeter, the tubular channel having at least one channel opening; and an elastic cord assembly, the elastic cord assembly including (i) an elongated elastic cord with first and second cord ends having an elastic elongation sufficient to at least double an unstretched length of the elastic cord and a cord width, the cord width being less than the channel diameter, (ii) a first ribbon distinct from the elastic cord having a first ribbon width and distal and proximal first ribbon ends with the first ribbon width being substantially greater than the channel diameter, and (iii) a second ribbon distinct from the elastic cord having a second ribbon width and distal and proximal second ribbon ends with the second ribbon width being substantially greater than the channel diameter;

wherein (a) the unstretched length of the elastic cord is 75% or less than an unbunched perimeter length of the tubular channel, (b) the elastic cord is substantially contained within the tubular channel wherein the tubular channel is bunched having an effective bunched perimeter length substantially the same as the unstretched length, (c) the proximal first ribbon end is joined to a first cord end, (d) the proximal second ribbon end is joined to a second cord end, and (e) substantially all of the first and second ribbons are outside of the tubular channel butted up against the at least one channel opening with the elastic cord assembly passing through the at least one channel opening.

* * * * *